US006052856A

United States Patent [19]

DeMoya et al.

[11] Patent Number: 6,052,856

[45] Date of Patent: Apr. 25, 2000

[54] FOOT WORN MOP SYSTEM

[76] Inventors: Laura M. DeMoya; Gerard L. DeMoya, both of 342 12th Ave., Indian Rocks Beach, Fla. 33785

[21] Appl. No.: 09/243,520

[22] Filed: Feb. 1, 1999

[51] Int. Cl.[7] ..... A47L 13/20; A47L 13/282

[52] U.S. Cl. ..... 15/227; 36/100; 36/136

[58] Field of Search ..... 15/227; 36/25 R, 36/100, 136

[56] References Cited

U.S. PATENT DOCUMENTS 3,526,917 9/1970 Haywood, Jr. .
3,699,672 10/1972 Sims .
5,173,985 12/1992 Palmer .
5,473,788 12/1995 Aragona .
5,613,897 3/1997 Thompson, Jr. .
5,644,813 7/1997 Puskas .

*Primary Examiner*—Randall E. Chin
*Attorney, Agent, or Firm*—Joseph N. Breaux

[57] ABSTRACT

A floor cleaning system that includes a mop assembly that is attachable to the user's foot. The mop assembly is constructed to be worn over the foot or the shoe of the user and includes a number of absorbent inserts that can absorb fluid from the floor contact sponge and that are not compressed by the weight of the user when the user walks. A number of detachable scrubbing pads are included that are attachable to the mop assembly.

1 Claim, 2 Drawing Sheets

FOOT WORN MOP SYSTEM

TECHNICAL FIELD

The present invention relates to floor cleaning devices and more particularly to a foot worn mop system that includes a mop sock assembly and a number of user attachable scrub pad members; the mop sock assembly including a moisture proof sock member, a moisture-absorbing sole member, and a floor contact sponge; the moisture proof sock member including an inner fabric liner, a middle moisture proof layer, an outer fabric layer, an elasticized foot insertion opening, a bottom surface and a hook and pile scrub pad attachment fastener; the moisture-absorbing sole member being constructed from a flexible, non-compressible plastic and including a number of the open-celled absorbent foam inserts positioned within cylinder shaped absorption cell cavities formed into an underside surface thereof; the floor contact sponge including a fabric backing portion permanently attached to the sole member and a section of absorbent sponge material permanently attached to the fabric backing material; the moisture-absorbing sole member being adhesively secured to the bottom of the sock member and in fluid flow communication with the open-celled absorbent foam inserts; the floor contact sponge being adhesively secured to the underside of the sole member; the scrub pad members including a scrub material layer and a hook and pile fastener section adhesively bonded onto the back surface of the scrub material layer that is companionate with the hook and pile scrub pad attachment fastener of the mop sock assembly.

BACKGROUND ART

Keeping a kitchen floor clean can require regular mopping to remove spills and the like that occur when cooking and preparing food. The mopping is typically done with a conventional multi-strand or sponge mop attached to the end of an elongated handle. These mops can be difficult for individuals with back injuries and the like to use. It would be a benefit, therefore, to have a foot worn mop system that included one or more mop assemblies that would be attachable to the user's foot. Because it is often easier to remove spills and the Like from floor surfaces before an extended drying period has occurred, it would be a further benefit to have a mop assembly that could be worn over the foot or shoe of the user while cooking or the like so that the spills could be mopped up soon after they occur. Because mops attached to the foot of the user can be constantly rung out by the weight of the user as the user walks, it would be a further benefit to have a mop assembly attachable to the foot of the user that includes a number of absorbent inserts that can absorb fluid from the floor contact sponge and that are not compressed by the weight of the user when the user walks. Because mopping is ineffective on some spots, it would be a further benefit to have a mop assembly attachable to the foot of the user that included a scrubbing pad for scrubbing hard to remove spots.

GENERAL SUMMARY DISCUSSION OF INVENTION

It is thus an object of the invention to provide a foot worn mop system that includes a mop assembly that is attachable to the user's foot. It is a further object of the invention to provide a foot worn mop system that includes a mop assembly that is be worn over the foot or shoe of the user.

It is a still further object of the invention to provide a foot worn mop system that includes a mop assembly that is worn over the foot or shoe of a user and that includes a number of absorbent inserts that can absorb fluid from the floor contact sponge and that are not compressed by the weight of the user when the user walks.

It is a still further object of the invention to provide a foot worn mop system that includes a mop assembly attachable to the foot of the user that includes a scrubbing pad for scrubbing hard to remove spots.

It is a still further object of the invention to provide a foot worn mop system that includes a mop sock assembly and a number of user attachable scrub pad members; the mop sock assembly including a moisture proof sock member, a moisture-absorbing sole member, and a floor contact sponge; the moisture proof sock member including an inner fabric liner, a middle moisture proof layer, an outer fabric layer, an elasticized foot insertion opening, a bottom surface and a hook and pile scrub pad attachment fastener; the moisture-absorbing sole member being constructed from a flexible, non-compressible plastic arid including a number of the open-celled absorbent foam inserts positioned within cylinder shaped absorption cell cavities formed into an underside surface theoreof; the floor contact sponge including a fabric backing portion permanently attached to the sole member and a section of absorbent sponge material permanently attached to the fabric backing portion; the moisture-absorbing sole member being adhesively secured to the bottom of the sock member and in fluid flow communication with the open-celled absorbent foam inserts; the floor contact sponge being adhesively secured to the underside of the sole member; the scrub pad members including a scrub material layer and a hook and pile fastener section adhesively bonded onto the back surface of the scrub material layer that is companionate with the hook and pile scrub pad attachment fastener of the mop sock assembly.

It is a still further object of the invention to provide a foot worn mop system that accomplishes all or some of the above objects in combination.

Accordingly, a foot worn mop system is provided. The foot worn mop system includes a mop sock assembly and a number of user attachable scrub pad members; the mop sock assembly including a moisture proof sock member, a moisture-absorbing sole member, and a floor contact sponge; the moisture proof sock member including an inner fabric liner, a middle moisture proof layer, an outer fabric layer, an elasticized foot insertion opening, a bottom surface and a hook and pile scrub pad attachment fastener; the moisture-absorbing sole member being constructed from a flexible, non-compressible plastic and including a number of the open-celled absorbent foam inserts positioned within cylinder shaped absorption cell cavities formed into an underside surface thereof; the floor contact sponge including a fabric backing portion permanently attached to the sole member and a section of absorbent sponge material permanently attached to the fabric backing portion; the moisture-absorbing sole member being adhesively secured to the bottom of the sock member and in fluid flow communication with the open-celled absorbent foam inserts; the floor contact sponge being adhesively secured to the underside of the sole member; the scrub pad members including a scrub material layer and a hook and pile fastener section adhesively bonded onto the back surface of the scrub material layer that is companionate with the hook and pile scrub pad attachment fastener of the mop sock assembly.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
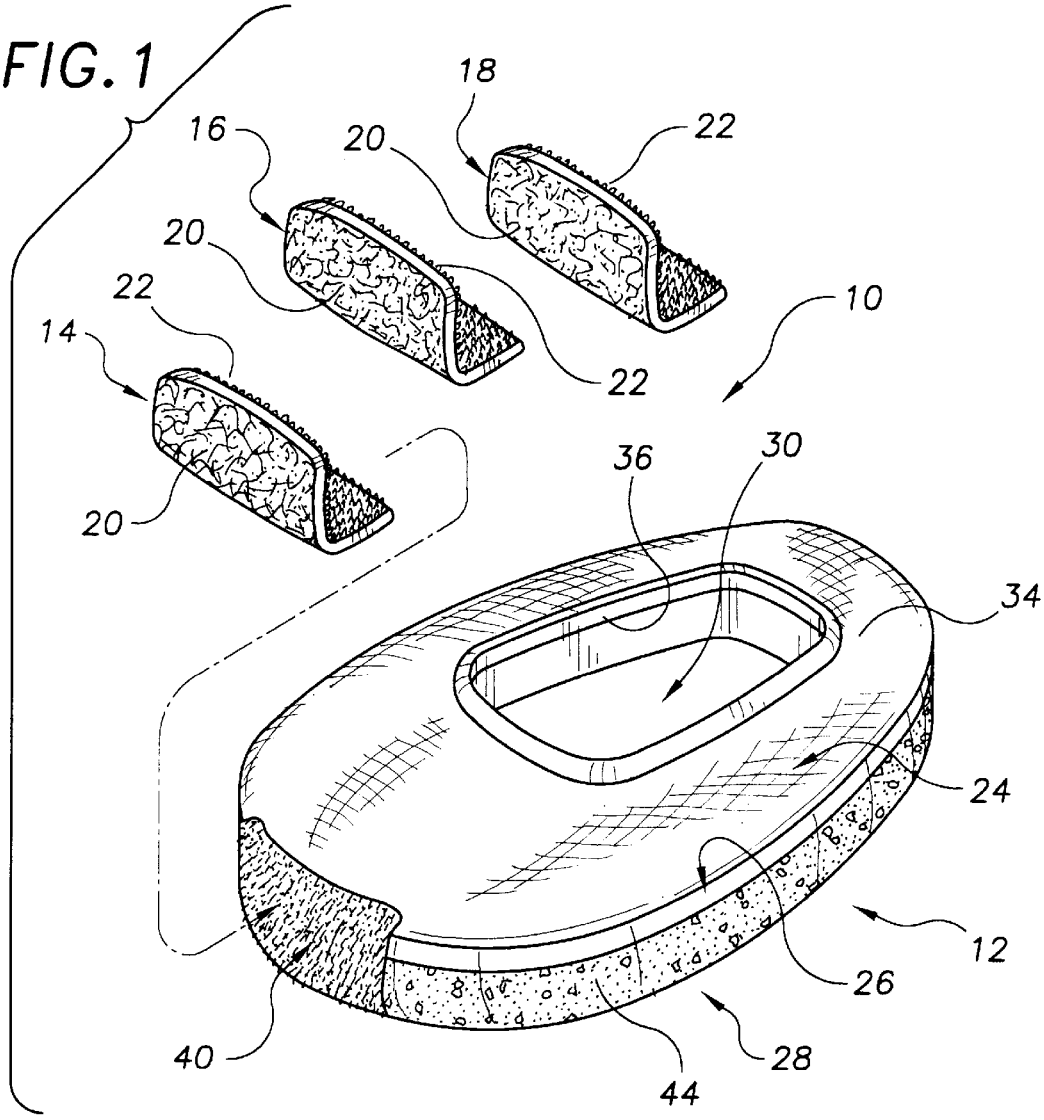
FIG. 1 is a perspective view of an exemplary embodiment of the foot worn mop system of the present invention showing the mop sock assembly including the moisture proof sock member with the elasticized foot insertion opening and the hook and pile scrub pad attachment fastener, the moisture-absorbing sole member adhesively secured to the bottom of the sock member, and the floor contact sponge adhesively secured to the underside of the sole member; and three scrub pad members including a light duty scrub pad, a medium duty scrub pad and a heavy duty scrub pad, each having a hook and pile fastener section on the back surface thereof that is companionate with the hook and pile scrub pad attachment fastener of the mop sock assembly.

FIG. 1 shows an exemplary embodiment of the foot worn mop system of the present invention generally designated 10. Foot worn mop system 10 includes a mop sock assembly, generally designated 12; a light duty scrub pad member, generally designated 14; a medium duty scrub pad member, generally designated 16; and a heavy duty scrub pad member, generally designated 18. Each scrub pad member 14,16,18 has a scrub material layer 20 having a hook and pile fastener section 22 bonded to the back surface thereof.

Mop sock assembly 12 includes a moisture proof sock member, generally designated 24; a moisture-absorbing sole member, generally designated 26; and a floor contact sponge, generally designated 28. Moisture proof sock member 24 includes an inner fabric liner 30, a middle moisture proof layer 32 (FIG. 5), an outer fabric layer 34, an elasticized foot insertion opening 36, a bottom surface 38 and an L-shaped hook and pile scrub pad attachment fastener 40 that is companionate with the hook and pile fastener section 22 of each L-shaped scrub pad member 14,16,18.

Figure 2:
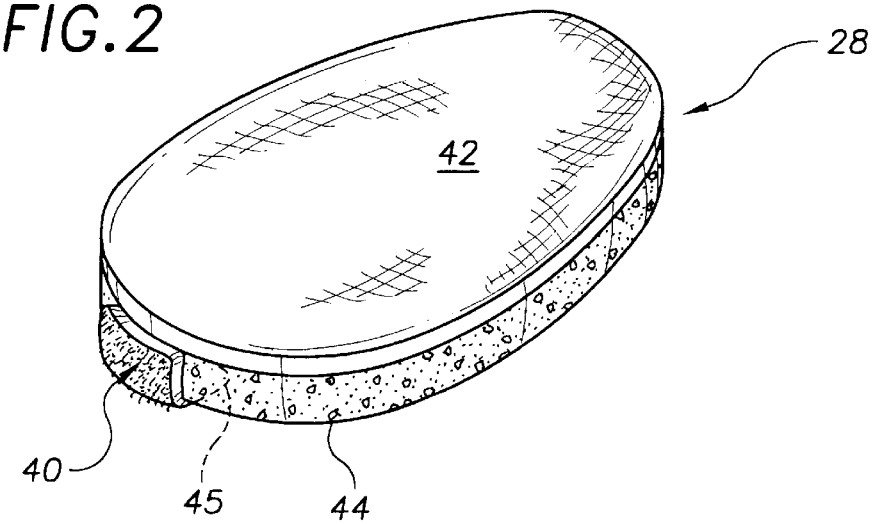
FIG. 2 is a perspective view of the floor contact sponge of the mop sock assembly in isolation showing the upper side of the fabric portion arid the section of absorbent sponge material extending from an underside thereof.
Figure 3:
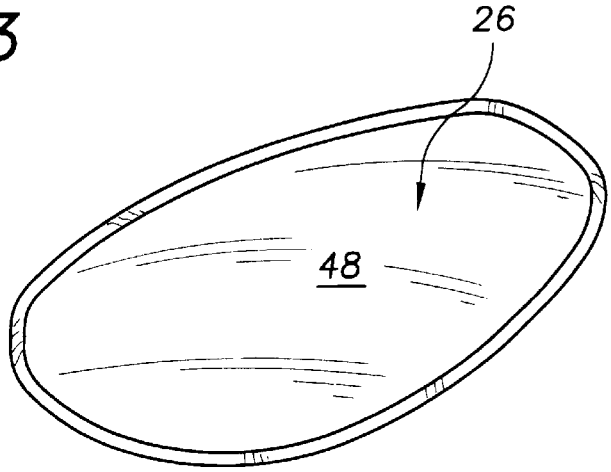
FIG. 3 is a perspective view of the sock member attachment surface of the moisture-absorbing sole member.
Figure 4:
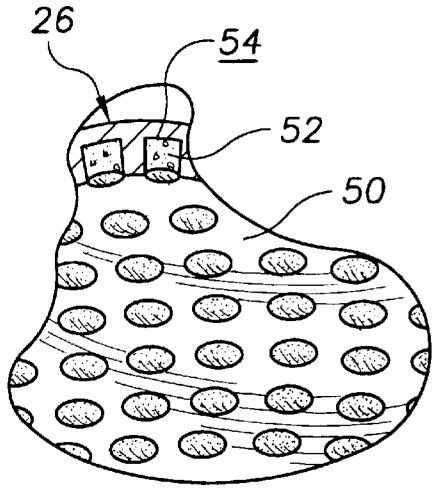
FIG. 4 is a partial cutaway perspective view of the underside of the moisture-absorbing sole member showing the mop pad attachment surface surrounding the open-celled absorbent foam inserts positioned within the cylinder shaped absorption cell cavities formed into the moisture-absorbing sole member, the moisture-absorbing sole member being constructed from a flexible, non-compressible plastic such that the weight of a user standing on the moisture-absorbing sole member does not squeeze out fluids absorbently held by the open-celled absorbent foam inserts positioned within the cylinder shaped absorption cell cavities.
Figure 5:
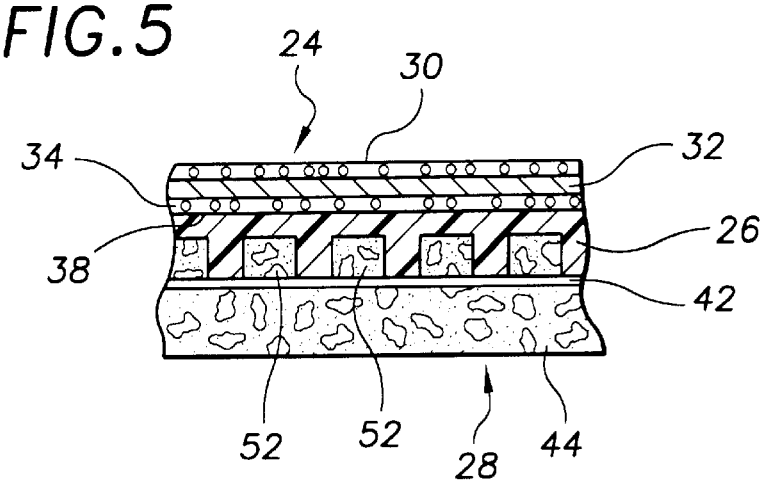
FIG. 5 is a cross section view showing the inner fabric liner of the mop sock member, the middle moisture proof layer of the mop sock member; the outer fabric layer of the mop sock member; the moisture-absorbing sole member including a number of the open-celled absorbent foam inserts positioned within the cylinder shaped absorption cell cavities; and the floor contact sponge including the fabric backing portion permanently attached to the sole member and the section of absorbent sponge material permanently attached to the fabric backing portion.

Referring now to FIG. 2, floor contact sponge 28 includes a fabric backing portion 42 permanently attached to sole member 26 and a section of absorbent sponge material 44 permanently attached to fabric backing portion 42. A bottom portion 45 (shown in dashed lines) of L-shaped hook and pile scrub pad attachment fastener 40 extends under absorbent sponge material 44 to provide a forward scrubbing surface and a floor contact scrubbing surface. Referring to FIG. 3, moisture-absorbing sole member 26 is molded from a flexible, non-compressible plastic arid includes an upper surface 48 that is adhesively attached to the bottom 38 (FIG. 5) of moisture proof sock member 24 (FIG. 1) and, with reference to FIG. 4, an underside surface 50 having a number of open-celled absorbent foam inserts 52 positioned within cylinder shaped absorption cell cavities 54 formed into art underside surface thereof. Referring now to FIG. 5, moisture-absorbing sole member 26 is adhesively secured to sock member. Floor contact sponge 28 is adhesively attached to moisture-absorbing sole member 26 and is in fluid flow communication with the open-celled absorbent foam inserts 52 of moisture-absorbing sole member 26. The term fluid communication is used herein to mean water and other fluids can wick through floor contact sponge 28 in a manner to transfer moisture to the open-celled absorbent foam inserts 52.

It can be seen from the preceding description that a foot worn mop system has been provided that includes a mop assembly that is attachable to the user's foot; that includes a mop assembly that is to be worn over the foot or shoe of the user; that includes a mop assembly that is worn over the foot or shoe of a user and that includes a number of absorbent inserts that can absorb fluid from the floor contact sponge and that are not compressed by the weight of the user when the user walks; that includes a mop assembly attachable to the foot of the user that includes a scrubbing pad for scrubbing hard to remove spots; and that includes a mop sock assembly and a number of user attachable scrub pad members; the mop sock assembly including a moisture proof sock member, a moisture-absorbing sole member, and a floor contact sponge; the moisture proof sock member including an inner fabric liner, a middle moisture proof layer, an outer fabric layer, an elasticized foot insertion opening, a bottom surface and a hook and pile scrub pad attachment fastener; the moisture-absorbing sole member being constructed from a flexible, non-compressible plastic and including a number of the open-celled absorbent foam inserts positioned within cylinder shaped absorption cell cavities formed into an underside surface thereof; the floor contact sponge including a fabric backing portion permanently attached to the sole member and a section of absorbent sponge material permanently attached to the fabric backing portion; the moisture-absorbing sole member being adhesively secured to the bottom of the sock member and in fluid flow communication with the open-celled absorbent foam inserts; the floor contact sponge being adhesively secured o the underside of the sole member; the scrub pad members including a scrub material layer and a hook and pile fastener section adhesively bonded onto the back surface of the scrub material layer that is companionate with the hook and pile scrub pad attachment fastener of the mop sock assembly.

It is noted that the embodiment of the foot worn mop system described herein in detail for exemplary purposes is of course subject to many different variation in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the detailed herein are to be interpreted as illustrative and not in a limiting sense.

what is claimed is:

1. A foot worn mop system comprising:

a mop sock assembly; and a number of user attachable scrub pad members;

said mop sock assembly including a moisture proof sock member, a moisture-absorbing sole member, and a floor contact sponge;

said moisture proof sock member including an inner fabric liner, a middle moisture proof layer, an outer fabric layer, an elasticized foot insertion opening, a bottom surface and a hook and pile scrub pad attachment fastener;

said moisture-absorbing sole member being constructed from a flexible, non-compressible plastic and including a number of open-celled absorbent foam inserts positioned within cylinder shaped absorption cell cavities formed into an underside surface thereof;

said floor contact sponge including a fabric backing portion permanently attached to the sole member and a section of absorbent sponge material permanently attached to the fabric backing portion;

said moisture-absorbing sole member being adhesively secured to said bottom of said sock: member and in fluid flow communication with said open-celled absorbent foam inserts;

said floor contact sponge being adhesively secured no said underside of said sole member;

said scrub pad members including a scrub material layer and a took and pile fastener section adhesively bonded onto a back surface of said scrub material layer that is companionate with said hook and pile scrub pad attachment fastener of said mop sock assembly.

* * * * *